US010832857B2

(12) United States Patent
Lee et al.

(10) Patent No.: US 10,832,857 B2
(45) Date of Patent: Nov. 10, 2020

(54) COIL COMPONENT

(71) Applicant: SAMSUNG ELECTRO-MECHANICS CO., LTD., Suwon-Si (KR)

(72) Inventors: Dong Seob Lee, Suwon-Si (KR); Sang Seob Kim, Suwon-Si (KR); Young Sun Kim, Suwon-Si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 164 days.

(21) Appl. No.: 16/017,088

(22) Filed: Jun. 25, 2018

(65) Prior Publication Data

US 2019/0180928 A1 Jun. 13, 2019

(30) Foreign Application Priority Data

Dec. 11, 2017 (KR) ..... 10-2017-0169387

(51) Int. Cl.

| | |
|---|---|
| ***H01F 27/24*** | (2006.01) |
| ***H01F 27/32*** | (2006.01) |
| ***H01F 27/28*** | (2006.01) |
| ***H01F 27/29*** | (2006.01) |

(52) U.S. Cl.

CPC ..... *H01F 27/327* (2013.01); *H01F 27/24* (2013.01); *H01F 27/2804* (2013.01); *H01F 27/292* (2013.01); *H01F 2027/2809* (2013.01)

(58) Field of Classification Search

CPC .... H01F 27/327; H01F 27/2804; H01F 27/24; H01F 27/292; H01F 27/323; H01F 27/30; H01F 27/255; H01F 27/32; H01F 2027/2809; H01F 17/0006; H01F 2017/002; H01F 2017/0073

USPC ..... 336/200, 223, 205, 192

See application file for complete search history.

(56) References Cited

U.S. PATENT DOCUMENTS

| | | | | |
|---|---|---|---|---|
| 6,996,892 | B1 * | 2/2006 | Dening | H01F 17/0013 29/602.1 |
| 2005/0068150 | A1 * | 3/2005 | Matsutani | H01F 17/04 336/223 |
| 2005/0140488 | A1 * | 6/2005 | Shimoyama | H01F 17/0006 336/200 |

(Continued)

FOREIGN PATENT DOCUMENTS

| | | | |
|---|---|---|---|
| JP | 2006-059957 | A | 3/2006 |
| KR | 10-1999-0066108 | A | 8/1999 |
| KR | 10-2016-0026710 | A | 3/2016 |

*Primary Examiner* — Mang Tin Bik Lian

(74) *Attorney, Agent, or Firm* — Morgan, Lewis & Bockius LLP

(57) ABSTRACT

A coil component includes: a body; and external electrodes disposed on an external surface of the body. The coil part may include a first coil layer and a second coil layer connected to the first coil layer, each of the first and second coil layers may include a plurality of coil patterns, the plurality of coil patterns of the first coil layer may include a first connection coil pattern physically connected to the second coil layer, the plurality of coil patterns of the second coil layer may include a second connection coil pattern physically connected to the first connection coil pattern, and an upper surface of the first connection coil pattern may come into direct contact with a lower surface of the second connection coil pattern.

21 Claims, 2 Drawing Sheets

I-I'

(56) References Cited

U.S. PATENT DOCUMENTS

| | | | | |
|---|---|---|---|---|
| 2008/0001701 | A1* | 1/2008 | Gardner | H01F 3/12 336/223 |
| 2013/0141206 | A1* | 6/2013 | Lee | H01F 17/0006 336/200 |
| 2013/0244343 | A1* | 9/2013 | Chang | H01L 23/5329 438/3 |
| 2014/0009254 | A1* | 1/2014 | Ohkubo | H01F 27/2804 336/192 |
| 2014/0285305 | A1* | 9/2014 | Yoo | H01F 27/2804 336/200 |
| 2015/0048918 | A1* | 2/2015 | Park | H01F 17/0013 336/200 |
| 2015/0325363 | A1* | 11/2015 | Chang | H01F 17/04 336/192 |
| 2016/0064319 | A1 | 3/2016 | Suzuki | |
| 2016/0086721 | A1* | 3/2016 | Park | H01F 27/2804 336/200 |
| 2016/0293320 | A1* | 10/2016 | Kim | H01F 17/0013 |

* cited by examiner

COIL COMPONENT

CROSS-REFERENCE TO RELATED APPLICATION(S)

This application claims the benefit of priority to Korean Patent Application No. 10-2017-0169387 filed on Dec. 11, 2017, in the Korean Intellectual Property Office, the disclosure of which is incorporated herein by reference in its entirety.

TECHNICAL FIELD

The present disclosure relates to a coil component, and more particularly, to an inductor corresponding to a passive element component.

BACKGROUND

In accordance with the development of information technology (IT), apparatuses have been rapidly miniaturized and thinned. Therefore, market demand for small, thin devices has increased.

Korean Patent Laid-Open Publication No. 10-1999-0066108 provides a power inductor including a board having a via hole and coils disposed on both surfaces of the board and electrically connected to each other by a via hole in the board, in line with technical trends, thereby making an effort to provide an inductor including coils having an uniform and high aspect ratio.

SUMMARY

An aspect of the present disclosure may provide a coil component capable of satisfying demand for a low-profile coil component and solving a reliability problem such as an open failure.

According to an aspect of the present disclosure, a coil component may include: a body including a coil part; and external electrodes disposed on an external surface of the body. The coil part may include a first coil layer and a second coil layer electrically connected to the first coil layer. Each of the first and second coil layers may include a plurality of coil patterns, the plurality of coil patterns of the first coil layer may include a first connection coil pattern physically connected to the second coil layer, and the plurality of coil patterns of the second coil layer include a second connection coil pattern physically connected to the first connection coil pattern. An upper surface of the first connection coil pattern may come into direct contact with a lower surface of the second connection coil pattern.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Figure 1:
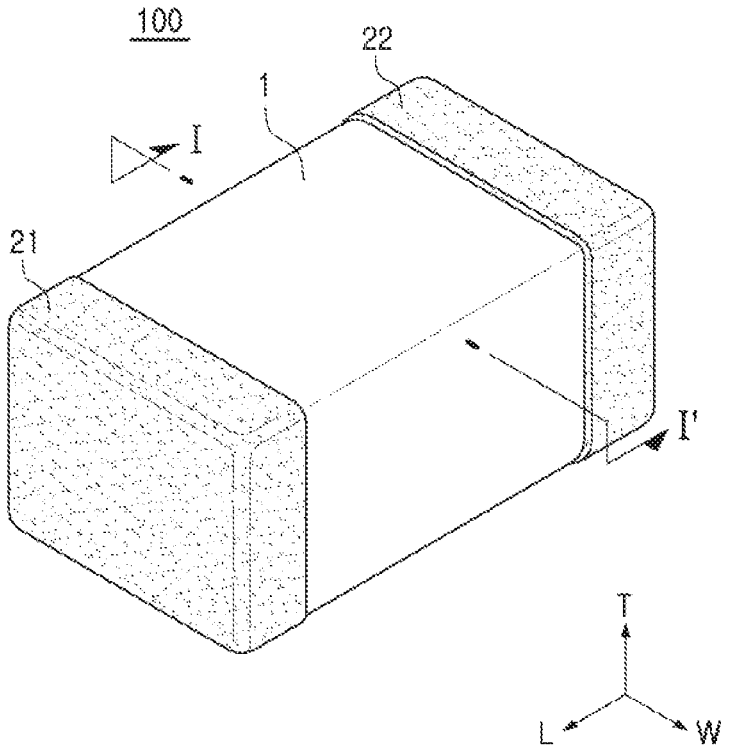
FIG. 1 is a schematic perspective view illustrating a coil component according to an exemplary embodiment in the present disclosure.

Hereinafter, exemplary embodiments of the present disclosure will be described in detail with reference to the accompanying drawings. In the accompanying drawings, shapes, sizes, and the like, of components may be exaggerated or stylized for clarity.

The present disclosure may, however, be exemplified in many different forms and should not be construed as being limited to the specific embodiments set forth herein. Rather these embodiments are provided so that this disclosure will be thorough and complete, and will fully convey the scope of the disclosure to those skilled in the art.

The term "an exemplary embodiment" used herein does not refer to the same exemplary embodiment, and is provided to emphasize a particular feature or characteristic different from that of another exemplary embodiment. However, exemplary embodiments provided herein are considered to be able to be implemented by being combined in whole or in part one with another. For example, one element described in a particular exemplary embodiment, even if it is not described in another exemplary embodiment, may be understood as a description related to another exemplary embodiment, unless an opposite or contradictory description is provided therein.

The meaning of a "connection" of a component to another component in the description includes an indirect connection through a third component as well as a direct connection between two components. In addition, "electrically connected" means the concept including a physical connection and a physical disconnection. It can be understood that when an element is referred to with "first" and "second", the element is not limited thereby. They may be used only for a purpose of distinguishing the element from the other elements, and may not limit the sequence or importance of the elements. In some cases, a first element may be referred to as a second element without departing from the scope of the claims set forth herein. Similarly, a second element may also be referred to as a first element.

Herein, an upper portion, a lower portion, an upper side, a lower side, an upper surface, a lower surface, and the like, are decided in the accompanying drawings. For example, a first connection member is disposed on a level above a redistribution layer. However, the claims are not limited thereto. In addition, a vertical direction refers to the above-mentioned upward and downward directions, and a horizontal direction refers to a direction perpendicular to the above-mentioned upward and downward directions. In this case, a vertical cross section refers to a case taken along a plane in the vertical direction, and an example thereof may be a cross-sectional view illustrated in the drawings. In addition, a horizontal cross section refers to a case taken along a plane in the horizontal direction, and an example thereof may be a plan view illustrated in the drawings.

Terms used herein are used only in order to describe an exemplary embodiment rather than limiting the present disclosure. In this case, singular forms include plural forms unless interpreted otherwise in context.

Hereinafter, a coil component according to an exemplary embodiment in the present disclosure will be described, but is not necessarily limited thereto.

Figure 2:
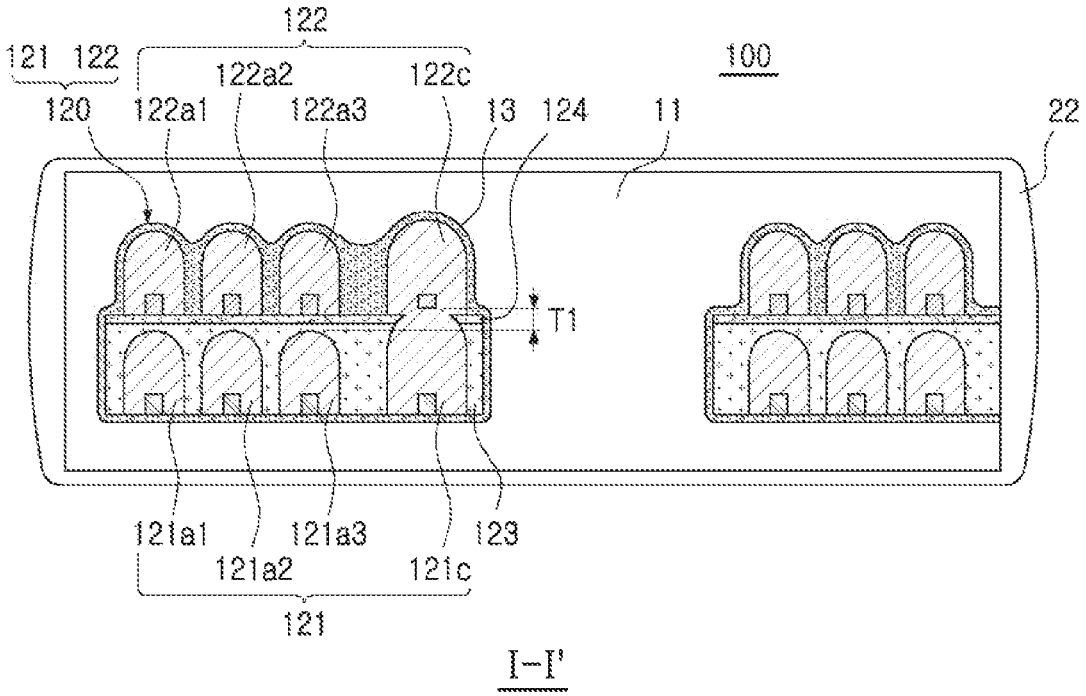
FIG. 2 is a cross-sectional view taken along line I-I' of FIG. 1.

FIG. 1 is a schematic perspective view of a coil component according to an exemplary embodiment in the present disclosure, and FIG. 2 is a cross-sectional view taken along line I-I' of FIG. 1.

Referring to FIGS. 1 and 2, a coil component 100 may include a body 1 and external electrodes 2. In this case, the external electrodes 2 may include first and second external electrodes 21 and 22 having different polarities from each other and spaced apart from each other on an external surface of the body.

The body 1 may form an exterior of the coil component and have upper and lower surfaces opposing each other in a thickness (T) direction, first and second side surfaces opposing each other in a width (W) direction, and first and second end surfaces opposing each other in a length (L) direction to have a substantially hexahedral shape. However, the body 1 is not is not limited thereto.

The body 1 may be filled with a magnetic material 11, and as the magnetic material, any material may be used as long as it contains a material having magnetic properties, and the magnetic material may be suitably selected by those skilled in the art as needed. For example, the magnetic material may be ferrite or a metal-resin composite material in which metal magnetic particles are dispersed in a resin.

A coil part 120 may be embedded by the magnetic material 11 of the body. The coil part 120 may include a first coil layer 121 and a second coil layer 122 connected thereto. The first coil layer may include a plurality of coil patterns and have a spiral shape formed by connection of the plurality of coil patterns. Similarly, the second coil layer may include a plurality of coil patterns and have a spiral shape formed by connection of the plurality of coil patterns. The first and second coil layer may have coil pattern structures corresponding to each other, but are not limited thereto. Here, the coil pattern structures corresponding to each other may include, for example, the numbers of turns of the coil patterns, line widths, thicknesses, aspect ratios, and the like, of the coil patterns. The first and second coil layers may be formed by suitably combining one or more of an isotropic plating method and anisotropic plating method based on a seed layer, and this method may be suitably designed and changed based on a desired shape, size and placement of the coil patterns in the first and second coil layers.

First, the first coil layer 121 may include the plurality of coil patterns, wherein the plurality of coil patterns include a first connection coil pattern 121C. The first connection coil pattern, which is a coil pattern serving as a mediator electrically connecting the first coil layer to the second coil layer, may be physically and directly connected to the second coil layer.

The first connection coil pattern may have a thickness thicker than that of other coil patterns 121*a*1, 121*a*2, and 121*a*3 of the first coil layer. A difference T1 in thickness between the first connection coil pattern and the other coil patterns is not limited, but the first connection coil pattern may have a thickness enough to allow an upper surface of the first connection coil pattern to be positioned higher than an upper surface of a first insulating layer 123 embedding the first coil layer.

A method of allowing the first connection coil pattern to have a thickness thicker than that of the other coil patterns is not particularly limited. For example, a method of further extending a plating time at the time of forming a final plating layer of the coil pattern, or a method of allowing a width of a coil pattern to be wider than that of other coil patterns to set the first connection coil pattern to be over-plated as compared to other coil patterns, may be used, but the method is not limited thereto.

The first insulating layer 123 disposed on the same plane as the first coil layer may contain an insulating resin or insulating magnetic sheet having insulation properties. The first insulating layer may be to insulate adjacent coil patterns in the first coil layer from each other. A method of forming the first insulating layer is not limited. For example, an insulating sheet may be laminated so as to encapsulate completed coil patterns. In this case, if necessary, the first insulating layer may be composed of a plurality of layers, and composed of different layers from each other in a thickness direction of the first coil layer.

The second insulating layer 124 may be disposed on the first insulating layer 123. The second insulating layer may be formed in a film shape. In order to miniaturize the coil component, the second insulating layer may be formed as thin as possible at a thickness at which the second insulating layer may support the second coil layer. For example, the second insulating layer 124 may have a thickness in a range from about 10 μm to about 20 μm. The reason is that when the thickness of the second insulating layer is thinner than 10 μm, a process handling level of the second insulating layer may be significantly increased, and the thickness is thicker than 20 μm, it may be difficult to satisfy the requirement to allow a coil pattern having a high aspect ratio to be included in a low-profile coil component, and a filling ratio of the magnetic material may be decreased corresponding to a degree of increase in thickness of the second insulating layer.

The second insulating layer 124 may include a hole penetrating through the thickness of the second insulating layer, and the first connection coil pattern may be connected to a second coil connection pattern by the hole.

The second coil layer 122 may be supported on the second insulating layer 124. The second coil layer 122 may include the second connection coil pattern 122*c* and a plurality of coil patterns 122*a*1, 122*a*2, and 122*a*3. The second connection coil pattern 122*c* may come into direct contact with the first connection coil pattern 121*c* of the first coil layer 121 to connect the first and second coil layers to each other.

Describing a connection structure between the first connection coil pattern of the first coil layer and the second connection coil pattern of the second coil layer in more detail, an upper surface of the first connection coil pattern may come into direct contact with a lower surface of the second connection coil pattern of the second coil layer. Here, the term "direct contact" means a physical contact and means a structure in which there is no separate via for connecting the first and second connection coil patterns to each other. The lower surface of the second connection coil pattern 122*c* may coincide with a lower surface of a seed layer of the second coil layer 122. The reason is that the second coil layer 122 may include coil patterns formed on the second insulating layer 124 by plating growth, and for the plating growth of the coil pattern, the seed layer is first formed on the second insulating layer.

The upper surface of the first connection coil pattern may be have any shape selected from a convex shape, a flat shape, and a concave shape as long as the seed layer of the second connection coil pattern is directly formed on the upper surface of the first connection coil pattern.

The first connection coil pattern may be formed to protrude from the first and second insulating layers. The reason is to omit a process of forming a separate via hole in the first and second insulating layers. Generally, in order to connect upper and lower coil layers to each other, there is a need to form a via hole in an insulating layer supporting the upper coil layer, but at the time of applying a laser for forming the via hole as described above, a residue of the insulating layer may remain on a bottom portion of the via hole, thereby causing an open failure at the time of interlayer connection of the coil layers. In the coil component 100 according to the present disclosure, in order to prevent the failure, after among the coil patterns of the first coil layer, the first connection coil pattern 121*c* to be connected to the second coil layer 122 is formed to be relatively thick, and the first and second insulating layers 123 and 124 are disposed on the first coil layer 121, a predetermined polishing method, or the like, may be performed so that the upper surface of the first connection coil pattern 121*c* may be exposed, and a laser drilling step for forming a via hole may be omitted. As a result, a problem such as the open failure occurring by the laser drilling for forming the via hole, or the like, does not occur.

Next, the coil part 120 including first coil layer 121, the first insulating layer 123 encapsulating the first coil layer 121, the second insulating layer 124 supporting the second coil layer 122 on the first insulating layer 123, and the second coil layer 122 may be enclosed by a third insulating layer 13. The third insulating layer 13 may be required for insulating a lower surface of the first coil layer 121 exposed by detaching the coil part from a substrate (not illustrated) used to form the coil part and the magnetic material from each other. Further, since the third insulating layer 13 may be formed along a surface of the coil pattern of the second coil layer 122, the third insulating layer 13 may serve to insulate the second coil layer 122 and the magnetic material 11 from each other.

Figure 3:
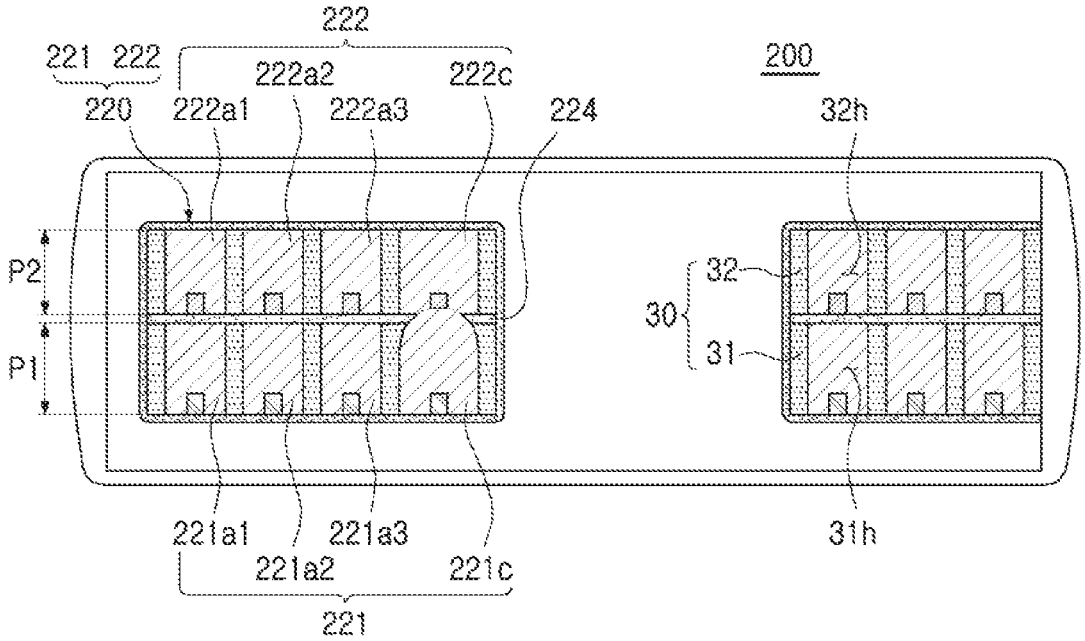
FIG. 3 is a cross-sectional view of a coil component according to a modified example of the coil component of FIGS. 1 and 2.

FIG. 3 illustrates a coil component 200 according to a modified example of the coil component of FIGS. 1 and 2. For convenience of explanation, a detailed description of configuration overlapping those of the coil component of FIGS. 1 and 2 will be omitted.

The coil component 200 illustrated in FIG. 3 is distinguished from the coil component 100 of FIGS. 1 and 2 in that the coil component 200 includes an insulating wall 30. The insulating wall 30 may include a first insulating wall 31 positioned on the same plane as a first coil layer 221 and a second insulating wall 32 positioned on the same plane of a second coil layer 222. The first and second insulating walls 31 and 32 may have insulation properties and be to insulate adjacent coil patterns, and widths, thicknesses, or aspect ratios of the first and second insulating walls may be suitably set by those skilled in the art in consideration of electrical properties of the coil component to be required.

Referring to FIG. 3, the first insulating wall 31 may include a first opening pattern 31*h*, and a coil pattern of the first coil layer 221 may be filled in the first opening pattern 31*h*. A thickness P1 of the first insulating wall 31 may be equal to or thicker than a thickness of other coil patterns except for a first connection coil pattern 221*c*. When the thickness of the first insulating wall 31 is thinner than that of the coil pattern, a short-circuit between adjacent coil patterns may occur, and there is a limitation in a function of the first insulating wall 31 as a plating growth guide of the first connection coil pattern 221*c*.

Similarly, the second insulating wall 32 may include a second opening pattern 32*h*, and a coil pattern of the second coil layer 222 may be filled in the second opening pattern. A thickness P2 of the second insulating wall 32 may be equal to or thicker than a thickness of other coil patterns except for a second connection coil pattern 222*c*. It is most preferable that the thickness P2 of the second insulating wall 32 is equal to that of the coil patterns.

A second insulating layer 224 supporting the second insulating wall 32 and insulating the first and second coil layers 221 and 222 from each other may be disposed between the first and second insulating walls 31 and 32, and the second insulating layer may be substantially the same configuration as the second insulating layer 224 of the above-mentioned coil component.

Since the coil component 200 includes the first and second insulating walls 31 and 32 including the opening patterns, in a case of forming the first and second coil layers 221 and 222 using the first and second insulating walls 31 and 32, it may be easy to implement a coil pattern having a high aspect ratio so as to have a fine line width.

As set forth above, according to exemplary embodiments in the present disclosure, a possibility of the open failure occurring at the time of interlayer connection between the coil layers of the coil component may be significantly decreased.

While exemplary embodiments have been shown and described above, it will be apparent to those skilled in the art that modifications and variations could be made without departing from the scope of the present invention as defined by the appended claims.

What is claimed is:

1. A coil component comprising:

a body including a coil part; and external electrodes disposed on an external surface of the body, wherein the coil part includes a first coil layer and a second coil layer connected to the first coil layer, each of the first and second coil layers includes coil patterns, the plurality of coil patterns of the first coil layer include a first connection coil pattern, the coil patterns of the second coil layer include a second connection coil pattern physically connected to the first connection coil pattern, and an upper surface of the first connection coil pattern comes in direct contact with a lower surface of the second connection coil pattern, wherein the coil part further includes a first insulating layer encapsulating upper surfaces of the plurality of coil patterns of the first coil layer except for the first connection coil pattern, and a second insulating layer disposed over the first insulating layer, and wherein the first connection coil pattern is disposed higher than an upper surface of the first insulating layer.

2. The coil component of claim 1, wherein the first connection coil pattern has a structure in which the first connection coil pattern protrudes from an upper surface of the first insulating layer.

3. The coil component of claim 1, wherein the second insulating layer comes in contact with a lower surface of the second coil layer.

4. The coil component of claim 3, wherein a thickness of the second insulating layer is in a range from 10 μm to 20 μm.

5. The coil component of claim 3, wherein the second insulating layer includes a hole penetrating from one surface of the second insulating layer to the other surface of the second insulating layer opposing one surface thereof.

6. The coil component of claim 5, wherein the hole is filled with the first connection coil pattern.

7. The coil component of claim 1, wherein the body further includes a magnetic material, and the magnetic material encapsulates the coil part.

8. The coil component of claim 1, wherein the first connection coil pattern of the first coil layer is thickest in the plurality of coil patterns included in the first coil layer.

9. The coil component of claim 1, wherein a first insulating wall is disposed between the plurality of coil patterns in the first coil layer, and a second insulating wall is disposed between the plurality of coil patterns in the second coil layer.

10. The coil component of claim 9, wherein the first insulating wall includes a first opening pattern, and the first opening pattern is filled with the coil patterns of the first coil layer, and the second insulating wall includes a second opening pattern, and the second opening pattern is filled with the coil patterns of the second coil layer.

11. The coil component of claim 9, wherein an upper surface of the first insulating wall is positioned to be lower than an upper surface of the first connection coil pattern.

12. The coil component of claim 9, wherein a material configuring the first and second insulating walls is different from a material configuring the second insulating layer.

13. The coil component of claim 1, wherein the body further includes a third insulating layer, and the coil part is enclosed by the third insulating layer.

14. The coil component of claim 13, wherein the third insulating layer comes in contact with a lower surface of the first coil layer.

15. The coil component of claim 13, wherein the third insulating layer is formed along an upper surface of the second coil layer.

16. The coil component of claim 1, wherein the first connection coil pattern is disposed between an upper portion of the first coil layer and a lower portion of the second coil layer.

17. A coil component comprising:

a body enclosing a coil part and comprising external electrodes electrically connected to the coil part;

the coil part comprising a first coil layer and a second coil layer, each of the first and second coil layers respectively comprising first and second coil patterns;

a first insulating layer disposed to insulate adjacent coil patterns of the first coil pattern from each other, the second coil layer being disposed on the first insulating layer;

a second insulating layer disposed over the first insulating layer, wherein a first connection coil pattern among the first coil patterns is thicker than a remainder of the first coil patterns such that an upper surface of the first connection coil pattern is disposed to be higher than an upper surface of the first insulating layer so as to physically contact a second connection coil pattern among the second coil patterns.

18. The coil component of claim 17, wherein the first connection coil pattern penetrates through the second insulating layer to contact the second connection coil pattern.

19. The coil component of claim 17, wherein the first insulating layer is disposed between the remainder of the first coil patterns and the second insulating layer so as to cover upper surfaces of the remainder of the first coil patterns.

20. The coil component of claim 17, further comprising a third insulating layer disposed to insulate adjacent coil patterns of the second coil pattern from each other.

21. The coil component of claim 20, wherein materials of the first insulating layer and the third insulating layer are different from a material of the second insulating layer.

* * * * *